US006539862B2

(12) United States Patent
Böck et al.

(10) Patent No.: US 6,539,862 B2
(45) Date of Patent: Apr. 1, 2003

(54) CHAMBERED DOCTOR BLADE ASSEMBLY

(75) Inventors: Thomas Böck, Neusäss (DE); Robert Konrad, Wiesenbach (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/875,699

(22) Filed: Jun. 6, 2001

(65) Prior Publication Data

US 2001/0050014 A1 Dec. 13, 2001

(30) Foreign Application Priority Data

Jun. 8, 2000 (DE) ..... 100 28 479

(51) Int. Cl.[7] ..... B41F 31/02; B41F 31/04

(52) U.S. Cl. ..... 101/364; 101/157; 101/350.1; 101/351.1; 101/352.01

(58) Field of Search ..... 101/157, 364, 101/365, 366, 350.1, 350.2, 351.1, 351.2, 352.01, 352.05

(56) References Cited

U.S. PATENT DOCUMENTS 512,562 A * 1/1894 Moore ..... 101/210
4,357,871 A * 11/1982 Kobler et al. ..... 101/350.1
4,438,694 A * 3/1984 Parkins et al. ..... 101/152
4,712,814 A * 12/1987 Petterson ..... 285/325
4,919,047 A * 4/1990 Inouye et al. ..... 101/175
5,243,907 A * 9/1993 Weishew ..... 101/208
5,325,775 A 7/1994 Grosshauser et al. ..... 101/366
5,967,044 A 10/1999 Marschke ..... 101/363

FOREIGN PATENT DOCUMENTS

DE 298 05 201 7/1998
EP 0047618 A1 * 3/1982

* cited by examiner

*Primary Examiner*—Andrew H. Hirshfeld
*Assistant Examiner*—Jill E Culler
(74) *Attorney, Agent, or Firm*—Cohen, Pontani, Lieberman & Pavane

(57) ABSTRACT

A chambered doctor blade assembly which can be placed against a roller of an inking unit of a printing machine, in particular onto an engraved roller, has a chamber connected to the surface of the roller by means of an orifice through which printing ink can flow. The orifice can be closed and re-opened by means of a closing element which is arranged within the chamber and which can be brought into a closing position. When the closing element is in the closing position, printing ink can continue to flow through the chamber.

14 Claims, 2 Drawing Sheets

CHAMBERED DOCTOR BLADE ASSEMBLY

BACKGROUND OF THE INVENTION

1. Field of the Invention

The invention relates to a chambered doctor blade assembly which can be placed against a roller of an inking unit of a printing machine, the assembly including a chamber having an orifice through which ink is introduced to the roller.

2. Description of the Related Art

In anilox printing units, chambered doctor blade assemblies are often used in planographic and flexographic printing in order to ink anilox rollers. The designation "engraved rollers" is also customary for anilox rollers, since cells capable of being filled with ink are arranged in the form of a grid in their surface. DE 298 05 201 U1 discloses a chambered doctor blade assembly which is placed against an engraved roller of a rotary offset printing machine and which is connected to an ink duct. The printing ink from the ink duct is pumped with the aid of an ink pump to a chamber of the chambered doctor blade assembly, the chamber being connected to the surface of the engraved roller by means of an orifice, in order to flush and fill the cells of the engraved roller.

In the case of a change of ink, however, there is the problem that all the parts which have come into contact with ink have to be cleaned, that is to say, for example, also return ducts and connecting hoses. This is highly complicated, above all in the case of planographic machines. Since the ink dries on the parts of the chambered doctor blade assembly, the parts which have come into contact with ink have to be de-mounted and cleaned. The new ink must subsequently be pumped into the then clean chambered doctor blade assembly, which takes up a certain amount of time.

SUMMARY OF THE INVENTION

By contrast, the object on which the present invention is based is to provide a chambered doctor blade assembly of the type mentioned in the introduction, by means of which a rapid change of ink is possible.

This object is achieved, according to the invention, by means of a closing element merged in the chamber and movable between a closing position, in which ink can flow through the orifice onto the roller, and a closing position, in which the orifice is closed and ink can still circulate through the chamber.

When the chambered doctor blade assembly according to the invention is removed from the impression roller on the occasion of a change of ink, complicated cleaning may be dispensed with, because the chamber is closed in an ink-tight and air-tight manner by the closing element and the printing ink, still located in the chamber, is therefore not exposed to any drying or oxidation processes. The chambered doctor blade assembly, together with the stored printing ink, consequently remains storable in this state until further use and can be re-used without further cleaning or refilling work. As a result, on the one hand, time is saved and, on the other hand, less cleaned-off ink has to be disposed of.

Furthermore, even with the orifice closed, that is to say without ink being applied to the impression roller, printing ink is capable of flowing through the chamber. Consequently, printing ink can continue to be circulated within a closed ink circuit. This is advantageous, particularly before the start of printing, in order to lower the viscosity of the ink, due to its thixotropy, at this early stage to a level which would otherwise occur only later during printing operations. The circulation of printing ink can take place even without the chambered doctor blade assembly being placed against the impression roller, with the result that the wear of the roller and of the doctor blades are reduced.

According to preferred embodiments, the chambered doctor blade assembly is releasably connected to ink-supplying lines and to ink-discharging lines by means of selfclosing couplings. The chambered doctor blade assembly can thereby be uncoupled from the ink circuit, without the ink located in the chamber drying out or coming into contact with oxygen.

According to a development of the invention, in the closing position, sealing surfaces of the closing element can be brought to bear on matching sealing surfaces of a chambered doctor blade assembly housing, at least one of the sealing surfaces being provided with a soft coating. Consequently, elastic adaptation of the sealing surfaces to one another can take place, with the result that the sealing effect is improved.

According to a preferred embodiment, the closing element is formed by a strip which extends parallel to the roller axis and which is capable of being moved back and forth radially with respect to the roller between bearing contact on a bottom-side abutment in the chambered doctor blade assembly housing (opening position) and bearing contact on the sealing surfaces of the chambered doctor blade assembly housing (closing position). In the closing position, a bypass conduit for the ink flow is then present between the bottom-side housing abutment and a bottom surface of the strip. The pressure force acting on the bottom surface of the strip and originating from the ink pressure within the ink circuit consequently advantageously assists the bearing contact of the strip on the sealing surfaces and ensures an improved sealing effect.

According to a further embodiment, the closing element is formed by a tube which extends parallel to the roller axis and is rotatably mounted within the chamber. A circularly arcuate closing body on the outer surface of the tube is integrally formed. In angular opening position, this body faces away from the engraved roller. In order to close the orifice, the closing body can be rotated into the latter tangentially into an angular closing position in which it is located opposite the engraved roller. In this case, the inflow of printing ink takes place through the tube interior, a tube wall of the tube being provided with at least one passage bore which is arranged downstream of the closing body, as seen in the direction of flow of the ink. This bore precedes the orifice in the angular opening position, in order to supply printing ink to the orifice, and follows the orifice in the angular closing position, in order to discharge the printing ink via a return-flow conduit in the bottom of the chambered doctor blade assembly housing. The flow cross section of the tube, in this case, is large as compared with that of the passage bore. By virtue of this measure, the ink is first distributed along the longitudinal extent of the tube running parallel to the roller, before it is transferred through the orifice onto the roller, thus bringing about a uniform distribution of the ink over the length of the roller.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
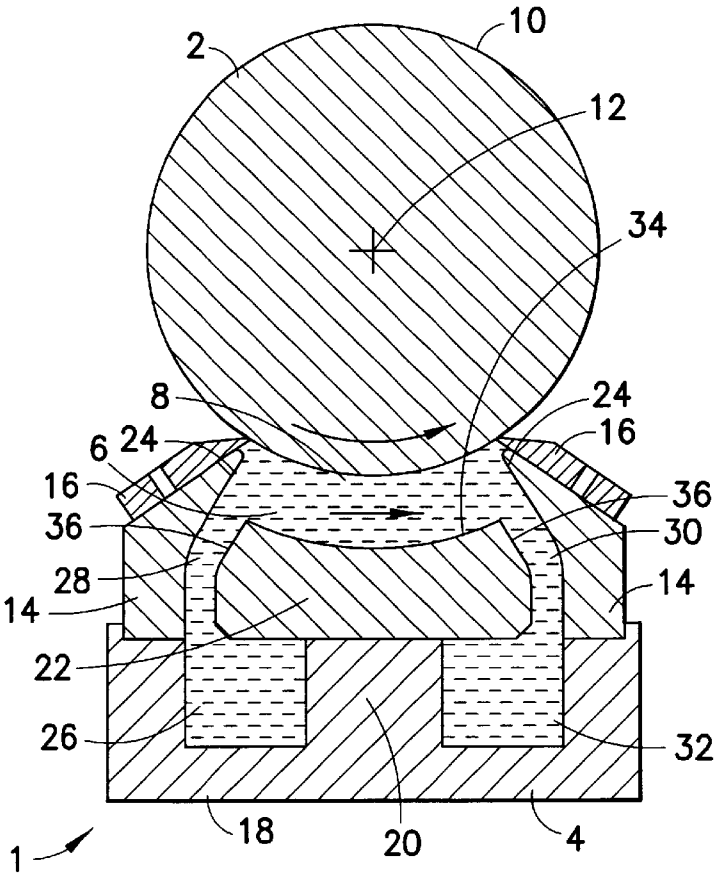
FIG. 1 shows a preferred exemplary embodiment of a chambered doctor blade assembly placed against an engraved roller, with a closing element in the opening position.

In FIG. 1, a chambered doctor blade assembly 1 according to the invention is placed against an engraved roller 2 in the inking unit of a printing machine. The chambered doctor blade assembly 1 comprises a housing 4 with a chamber 6 which is connected by means of an orifice 8 to the surface 10 of the engraved roller 2, in order to flush and fill with ink the cells formed there. The housing 4 is delimited, on the one hand, by two longitudinal walls 14 which extend parallel to the engraved-roller axis 12 and the roller sides of which each carry a doctor blade 16, the doctor blade edge of which stands against the surface 10 of the engraved roller 2.

On the side facing away from the engraved roller 2, the chamber 6 is closed off by means of a bottom 18, on which is arranged a preferably centrally inward-projecting abutment 20 for a closing element which is capable of being moved within the housing 4, preferably in the radial direction with respect to the engraved roller 2, and which is preferably designed as a strip 22, extending parallel to the engraved-roller axis 12. In the situation shown in FIG. 1, the closing element 22 is in an opening position. As seen in the circumferential direction with respect to the rotation of the engraved roller 2, the orifice 8 is arranged between two mutually inclined sealing surfaces 24 of the longitudinal walls 14. The chamber 6 is delimited laterally by two end walls, not illustrated in the figures, so that printing ink located in the chamber 6 can come into contact with the surface 10 of the engraved roller 2 solely through the orifice 8.

The chamber 6 can be supplied with ink by means of an inflow conduit 26 which is arranged in the bottom 18 of the housing 4 and, for example, runs parallel to the engraved roller axis 12 and which is connected by means of an ink inflow to an ink duct, not illustrated, and to which printing ink from the ink duct is supplied with the aid of an ink pump. The chambered doctor blade assembly 1 is therefore supplied with ink laterally.

The inflow conduit 26 is delimited by the bottom 18 of the housing 4, by the abutment 20 and by that part of the strip 22 which projects beyond the abutment 20, and precedes the orifice 8 with respect to the direction of flow of the ink, as illustrated by an arrow in FIG. 1. Starting from the inflow conduit 26, the ink passes through a radially running first overflow conduit 28, narrowed in cross section, as compared with the inflow conduit, and formed between a longitudinal surface of the strip 22 and an inner surface of the longitudinal wall 14 of the housing 4, into the chamber 6 and from there can pass through the orifice 8 onto the surface 10 of the engraved roller 2. Since the flow cross section of the inflow conduit 26 running parallel to the engraved roller axis 12 is large, as compared with the flow cross section of the radially running first overflow conduit 28, which in this respect forms a throttle, the ink is first distributed in the inflow conduit 26 in the direction of the longitudinal extent of the engraved roller 2, before it flows via the first overflow conduit 28 to the orifice 8. A uniform distribution of the ink along the longitudinal extent of the engraved roller 2 thereby takes place. The direction of flow of the ink in the chamber 6 in the region of the orifice 8 is essentially parallel to and co-directional with the circumferential movement of the engraved roller 2 and tangential to the surface 10 of the latter, as illustrated by the arrows in FIG. 1. The flow of ink is thereby assisted.

The return flow of ink out of the chamber 6 takes place through a second overflow conduit 30 which is arranged symmetrically to the first overflow conduit 28 and is formed between the strip 22 and the inner surface of the further longitudinal wall 14 of the housing 4. The second overflow conduit 30 issues into a bottom-side return-flow conduit 32 which is connected to an ink return. The return-flow conduit 32 is delimited by the bottom 18 of the housing 4, by the abutment 20, and by that part of the strip 22 which projects beyond the abutment 20. Since the strip 22 rests sealingly on the abutment 20, the printing ink must therefore flow first around the strip 22 before it passes into the return-flow conduit 32.

The inflow conduit 26, the return-flow conduit 32, the two overflow conduits 28, 30 and the chamber 6 form a part of an ink circuit which is fixed to the chambered doctor blade assembly, the ink circuit having printing ink circulating in it and otherwise comprising the ink duct, the ink inflow, the ink return and the ink pump. The inflow conduit 26 and the return-flow conduit 32 are in each case provided on the end faces with releasably self-closing fluid couplings for the connection of the ink forward run and of the ink return. The symmetrical arrangement of the chambered doctor blade assembly 1 also makes it possible to transport the ink in the opposite direction to the arrows in FIG. 1.

As shown in FIG. 1, the strip 22 has a surface 34 facing the engraved roller 2, which surface has a circular concave cross section and preferably has the same radius as the roller 2. This surface 34 is arranged, as seen in the circumferential direction, between two sealing surfaces 36 of the strip 22 which are assigned to the sealing surfaces 24 of the housing 4 and are inclined to one another at the same angle as these. The marginal edges of this surface 34 are at a distance from one another which corresponds to the clear width of the orifice 8.

Figure 2:
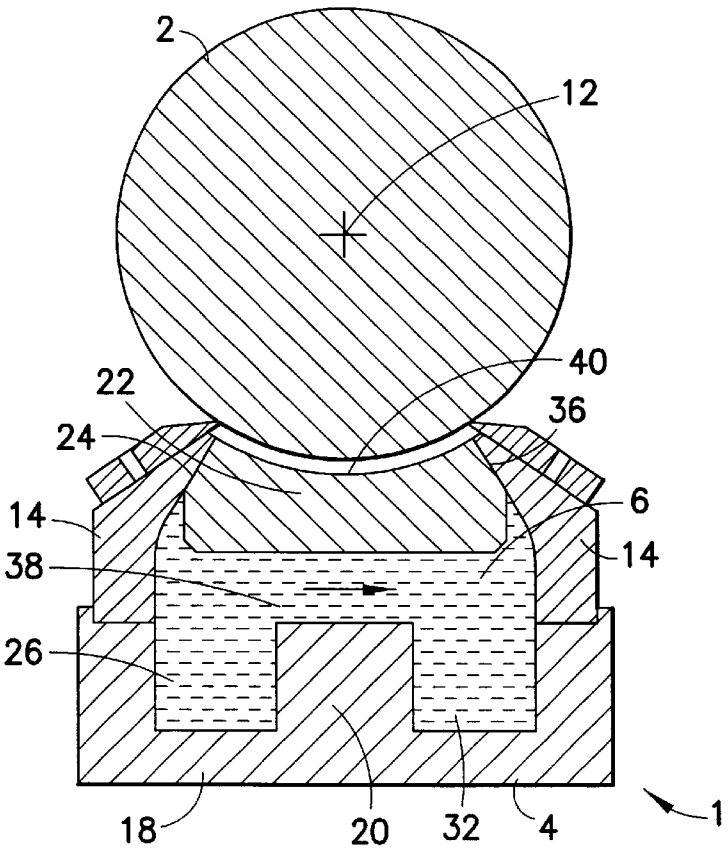
FIG. 2 shows embodiment of FIG. 1, with the closing element in the closing position.

FIG. 2 shows a closing position, in which the strip 22 closes the orifice 8 by being moved from the abutment 20 in the radial direction towards the engraved roller 2, until its sealing surfaces 36 bear in a wedge-like manner against the matching sealing surfaces 24 of the housing 4 and the orifice 8 is completely closed. The closing force acting on the strip 22 and generated, for example, by an actuating device, not illustrated, is in this case such that the chamber 6 is closed relative to surroundings in an ink-tight and air-tight manner. Between the abutment 20 and the bottom surface of the strip 22, a bypass conduit 38 is then obtained, through which ink can pass from the inflow conduit 26 directly into the return-flow conduit 32, without flowing around the strip 22. The bottom surface of the strip 22 is then subjected to the pressure prevailing in the ink circuit. This pressure ensures stabilization of the closing position and an improved sealing effect between the sealing surfaces 24, 36 which are assigned to one another and run obliquely with respect to the line of action of the pressure force. According to a development, the sealing surfaces 36 of the strip 22 and/or also the sealing surfaces 24 of housing 4 may be provided with a soft surface in order to achieve as great a sealing effect as possible.

Preferably, with the strip 22 in the closing position, the engraved roller 2 is switched to non-drive. Since preferably a small clearance 40 remains between that surface 34 of the strip 22 which faces towards the engraved roller 2 and the surface 10 of the engraved roller 2, the strip 22 can be brought into the closing position even while the engraved roller 2 is in rotation. Due to the closing movement, at least part of the ink located in the chamber 6 is then conveyed onto the surface 10 of the engraved roller 2, which continues to rotate, and is thereby transported away. No ink residues therefore remain on the chambered doctor blade assembly 1 which can thereupon be separated from the ink supply, removed from the inking unit and stored without additional cleaning.

When the strip 22 is in the closing position, ink can continue to be pumped around within the ink circuit, since the ink flows from the inflow conduit 26 through the bypass conduit 38 directly into the return-flow conduit 32. This is advantageous, in particular, for lowering the viscosity of the ink due to its thixotropy, even before the start of printing, to a level which would otherwise be established only during later printing operations.

Figure 3:
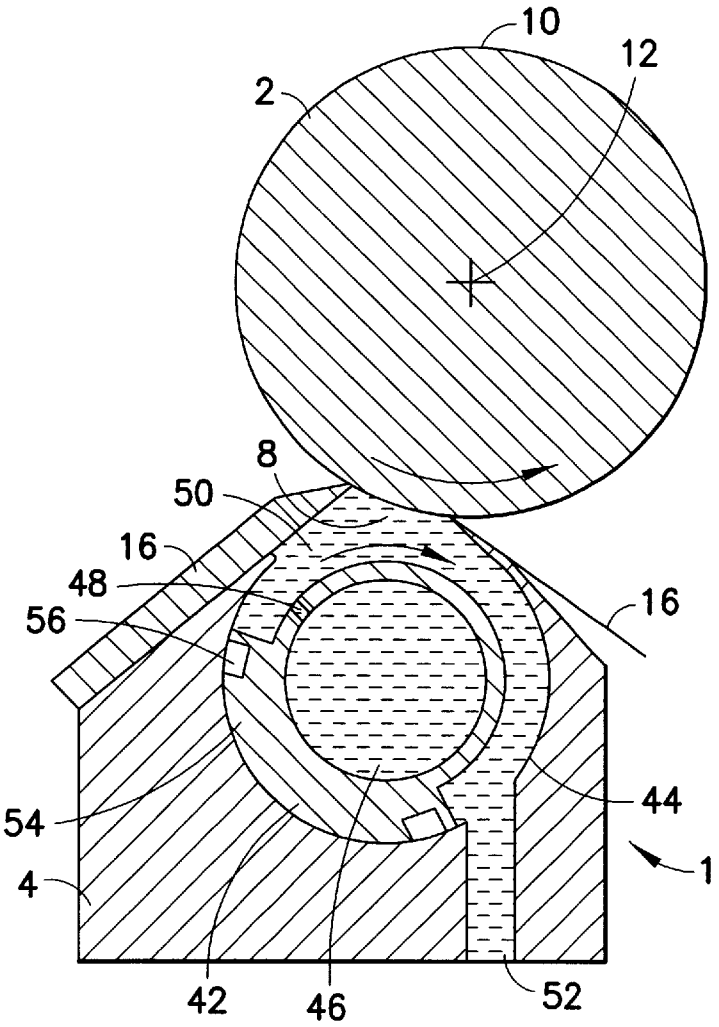
FIG. 3 shows a further embodiment, with a closing element in the opening position.

FIG. 3 shows a further embodiment of the chambered doctor blade assembly 1 according to the invention, the closing element being designed as a tube 42 which is mounted rotatably parallel to the engraved roller 2 within a cylindrical guide surface 44 of the housing 4 and, in the opening position, assumes an angular opening position which releases in the guide surface 44 an orifice 8 which points towards the engraved roller 2 and through which ink can be transported onto the surface 10 of the engraved roller 2.

An ink inflow line is connected to the tube interior 46 which consequently assumes the function of an inflow conduit. The tube wall of the tube 42 has at least one passage bore 48, through which the ink located in the tube interior 46 can pass into an annular chamber 50 which is formed between the guide surface 44 of the housing 4 and the tube 42 and from which ink is flushed through the orifice 8 onto the surface 10 of the engraved roller 2. In the angular opening position of the tube 42, as shown in FIG. 3, the passage bores 48 are located, as seen in the direction of flow of the ink, in a position preceding the orifice 8.

As in the exemplary embodiment described above, the direction of flow of the ink in the annular chamber 50 in the region of the orifice 8 is parallel to and co-directional with the circumferential movement of the engraved roller 2 and tangential to the surface 10 of the latter. The printing ink flows from the annular chamber 50 through a return-flow conduit 52, issuing into the guide surface 44 on the bottom side, into a return line and from there into an ink duct.

Integrally formed as a closing body 54 on the outer surface of the tube wall is a circularly arcuate projection which, in the angular opening position, is located on the side facing away from the engraved roller 2. By the closing body 54 being rotated in the direction of flow of the ink and tangentially into the orifice 8, the closing body passes into an angular closing position, shown in FIG. 4, which closes the orifice 8 and in which the closing body is located opposite the engraved roller 2. So that complete closing of the orifice 8 is possible, the arc length of the closing body 54 must be at least slightly greater than that of the void in the guide surface 44, the void forming the orifice 8. To receive seals, grooves 56 are provided in the closing body 54 which are open towards the guide surface 44 and extend in the tube longitudinal direction.

Figure 4:
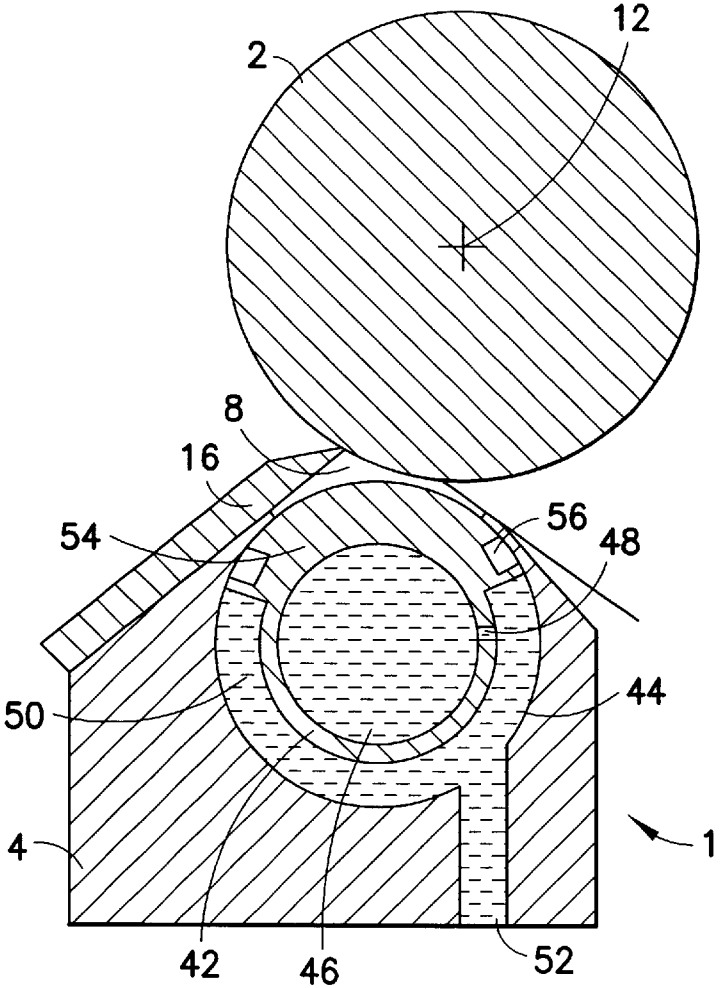
FIG. 4 shows the embodiment of FIG. 3, with the closing element in the closing position.

With respect to the direction of flow of the ink, the passage bore 48 is located downstream of the circularly arcuate closing body 54 and, in the angular opening position, upstream of the orifice 8. After the closing body 54 has been rotated tangentially into the orifice 8 (angular closing position), however, the passage bore 48 is located downstream of the orifice 8, so that the ink flowing over into the annular chamber 50 from the tube interior 46 via the passage bore 48 flows directly into the return-flow conduit 52 which the closing body 54 leaves open (FIG. 4). The mounting of the tube 42, together with the closing body 54, within the guide surface 44 of the housing 4 is carried out preferably by means of a snug fit, and therefore, in the angular closing position, the annular chamber 50 through which the ink flows is closed off relative to its surroundings in an ink-tight and air-tight manner.

The inside diameter of the tube 42 is large, as compared with the diameter of the passage bore 48, and therefore the ink first flows, distributed, along the longitudinal extent of the tube 42, before it flows into the annular chamber 50 communicating with the orifice 8.

In the two embodiments described above, the force for moving the closing elements 22, 42 from the closing position into the opening position and back is generated by means of an appropriate actuating device. Preferably, the closing elements 22, 42 consist of ink-repelling material or are coated with such a material. In addition, further or all components of the chambered doctor blade assembly 1 may also be provided with an ink-repelling layer.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A chambered doctor blade assembly which can be placed against a roller of an inking unit of a printing machine, said assembly comprising:

a housing comprising a chamber having an orifice through which ink is introduced to said roller, said housing having sealing surfaces facing said chamber and an abutment in said chamber, and a closing element arranged in said chamber and movable between an opening position, wherein ink can flow through said orifice onto said roller, and a closing position, wherein said orifice is closed and ink can still circulate through said chamber, said closing element comprising a strip which extends parallel to the roller axis, said strip having sealing surfaces which bear on said sealing surfaces of said housing when said closing element is in said closing position, said strip forming a bypass conduit for ink flow between said strip and said abutment when said closing element is in said closing position, said strip bearing against said abutment when said closing element is in said opening position.

2. An assembly as in claim 1 further comprising an inflow conduit and a return flow conduit extending parallel to the roller axis and separated by the abutment, and a pair of overflow conduits which extend essentially transversely to the roller axis, said overflow conduits connecting said inflow conduit to said orifice and connecting said orifice to said outflow conduit when said closing element is in the open position.

3. An assembly as in claim 1 wherein said strip has a surface with a circular concave cross section facing said roller, said surface having the same radius as said roller, said surface being spaced from said roller to provide a clearance when said closing element is in the closing position.

4. An assembly as in claim 1 wherein said sealing surfaces of said closing element are mutually inclined surfaces which run obliquely to the direction of movement of the closing element, and said sealing surfaces of said housing are mutually inclined surfaces which run obliquely to the direction of movement of the closing element, said closing element being wedged between said sealing surfaces of said housing when said closing element is in said closing position.

5. An assembly as in claim 1 wherein at least some of said sealing surfaces are provided with a soft coating.

6. An assembly as in claim 1 wherein said closing element comprises a layer of ink repelling material.

7. An assembly as in claim 1 wherein said closing element consists of an ink repelling material.

8. A chambered doctor blade assembly which can be placed against a roller of an inking unit of a printing machine, said assembly comprising:

a chamber having an orifice through which ink is introduced to said roller, and a closing element arranged in said chamber and movable between an opening position, wherein ink can flow through said orifice onto said roller, and a closing position, wherein said orifice is closed and ink can still circulate through said chamber, wherein said closing element comprises a tube which extends parallel to the roller axis, said tube having an outer surface with an arcuate closing body formed integrally thereon, said tube being rotatable so that said closing body faces away from said orifice in said opening position, and so that said closing body moves tangentially into said orifice in said closing position.

9. An assembly as in claim 8 further comprising an ink inflow conduit inside said tube and an ink return flow conduit in said housing, said tube having at least one passage communicating between said inflow conduit and said chamber, said passage being located so that ink flows past said orifice when said closing element is in said opening position, and so that ink flows directly to said return flow conduit when said closing element is in said closing position.

10. An assembly as in claim 9 wherein said inflow conduit has a flow cross section which is larger than the flow cross section of said at least one passage.

11. An assembly as in claim 8 further comprising a housing in which said chamber is formed, said housing having sealing surfaces facing said chamber, said closing element having sealing surfaces which bear on said sealing surfaces of said housing when said closing element is in said closing position.

12. An assembly as in claim 11 wherein at least some of said sealing surface are provided with a soft coating.

13. An assembly as in claim 8 wherein said closing element comprises a layer of ink repelling material.

14. An assembly as in claim 8 wherein said closing element consists of an ink repelling material.

* * * * *